US011661790B2

(12) United States Patent
Johnson et al.

(10) Patent No.: US 11,661,790 B2
(45) **Date of Patent: *May 30, 2023**

(54) DOOR COMPRISING VENTED STILE, AND METHOD OF MAKING THE SAME

(71) Applicant: Plastpro 2000, Inc., Los Angeles, CA (US)

(72) Inventors: Scott Evert Johnson, Kingsville, OH (US); Shirley Wang, Los Angeles, CA (US); Jared Andrew Garrett, Mentor, OH (US)

(73) Assignee: PLASTPRO 2000, INC., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/826,731

(22) Filed: May 27, 2022

(65) Prior Publication Data

US 2022/0290493 A1 Sep. 15, 2022

Related U.S. Application Data

(63) Continuation of application No. 16/891,221, filed on Jun. 3, 2020, now Pat. No. 11,377,902.
(Continued)

(51) Int. Cl.
*E06B 7/10* (2006.01)
*E06B 7/16* (2006.01)
(Continued)

(52) U.S. Cl.
CPC ..... *E06B 7/10* (2013.01); *E06B 3/30* (2013.01); *E06B 7/16* (2013.01); *E05Y 2900/132* (2013.01); *E06B 3/677* (2013.01)

(58) Field of Classification Search
CPC . E06B 3/677; E06B 3/30; E06B 3/307; E06B 2003/6638; E06B 2003/7023; E06B 2003/7028; E06B 2003/7036; E06B 2003/7038; E06B 2003/7073; E06B 2003/7078; E06B 2003/7094; E06B 7/10; E06B 7/16; E06B 2003/7098; E06B 7/1016; E06B 7/2301; E06B 7/2303;
(Continued)

(56) References Cited

U.S. PATENT DOCUMENTS 2,278,694 A 4/1942 Firner
3,932,971 A 1/1976 Day
(Continued)

FOREIGN PATENT DOCUMENTS

KR 200351876 Y1 6/2004

*Primary Examiner* — Kyle J. Walraed-Sullivan
(74) *Attorney, Agent, or Firm* — Duane Morris LLP

(57) ABSTRACT

A door includes a first skin, a second skin, two stiles, a core, and a gas permeable membrane. The first skin provides a first outer door surface. The second skin provides a second outer door surface. The two stiles are disposed at least partially between the first skin and the second skin. At least one stile defines a vent therein. The core comprises a foam material and is disposed between the first skin and the second skin. The gas permeable membrane, which is permeable to gas but not to the precursors of a foam material, is disposed on the at least one stile covering the vent. The gas permeable membrane contacts the foam material in the core, and separate the foam material in the core from the vent.

20 Claims, 13 Drawing Sheets

Related U.S. Application Data

(60) Provisional application No. 62/857,010, filed on Jun. 4, 2019.

(51) Int. Cl.
*E06B 3/30* (2006.01)
*E06B 3/677* (2006.01)

(58) Field of Classification Search
CPC .... E06B 7/2305; E06B 7/2307; E06B 7/2309; E05Y 2900/132
See application file for complete search history.

(56) References Cited

U.S. PATENT DOCUMENTS 4,113,905 A 9/1978 Kessler
4,236,365 A 12/1980 Wheeler
4,327,535 A 5/1982 Governale
4,374,693 A 2/1983 Pitt
4,394,806 A 7/1983 Day
4,542,611 A 9/1985 Day
4,576,841 A 3/1986 Lingemann
4,604,840 A 8/1986 Mondon
4,835,926 A 6/1989 King
4,942,704 A 7/1990 King
5,027,574 A 7/1991 Phillip
5,094,055 A 3/1992 Berdan
5,290,611 A 3/1994 Taylor
5,302,425 A 4/1994 Taylor
5,580,637 A 12/1996 Konta et al.
6,161,363 A 12/2000 Herbst
6,312,540 B1 11/2001 Moyes
6,430,889 B1 8/2002 Nixon, Sr.
7,587,876 B2 9/2009 Bartlett et al.
8,782,971 B2 7/2014 Milburn et al.
2001/0045080 A1 11/2001 Chen
2003/0200714 A1 10/2003 Minke et al.
2005/0028458 A1 2/2005 Rosskamp et al.
2007/0218224 A1 9/2007 Farbstein
2007/0261325 A1 11/2007 Rosskamp et al.
2008/0245003 A1 10/2008 Kon et al.
2010/0180526 A1 7/2010 An et al.
2010/0281787 A1 11/2010 Jay et al.
2011/0011006 A1 1/2011 Wuest et al.
2011/0120044 A1 5/2011 Bartlett et al.
2013/0101759 A1 4/2013 Jones
2013/0212957 A1 8/2013 Cempulik et al.
2014/0087098 A1 3/2014 Goodwin et al.
2014/0237918 A1* 8/2014 Miller ..... E06B 7/02 52/209
2015/0233173 A1 8/2015 Ferri et al.
2018/0030776 A1 2/2018 Vaidya et al.
2018/0080273 A1 3/2018 Wang
2018/0298673 A1 10/2018 Runze et al.
2019/0055774 A1 2/2019 Wang et al.
2019/0090660 A1 3/2019 Baquet et al.
2020/0263485 A1 8/2020 Kattmann et al.
2020/0370362 A1 11/2020 Moore, Jr. et al.
2020/0386042 A1 12/2020 Johnson et al.
2020/0408032 A1 12/2020 Schlögl
2021/0071466 A1 3/2021 Nüsser et al.

* cited by examiner

DOOR COMPRISING VENTED STILE, AND METHOD OF MAKING THE SAME

PRIORITY CLAIM AND CROSS-REFERENCE

This application is a continuation of U.S. patent application Ser. No. 16/891,221, filed Jun. 3, 2020, which claims priority to and the benefit of U.S. Provisional Application No. 62/857,010, filed Jun. 4, 2019, which applications are expressly incorporated by reference herein in their entirety.

FIELD

The disclosure relates to a door generally. More particularly, the disclosed subject matter relates to a door having an internal foam material and the method of making the same.

BACKGROUND

Doors include wooden doors and fiberglass doors. Fiberglass doors comprising synthetic polymers are used as substitutes for traditional wooden doors. Fiberglass doors include door skins (facings) secured to opposite sides of a rectangular door frame. A resulting cavity between the door skins and surrounded by the door frame optionally is filled with a core material. Doors so constructed can have wood graining printed, molded, or otherwise applied on the exterior surfaces of the door skins, and also raised paneling formed (e.g., molded) in the door skins. These features give the doors the appearance of natural wood fabricated products. Optionally, paint, stain, lacquer, and/or a protective layer may be applied to the exterior surface.

Foam or foamed parts are used to make a foam-filled door. The foam may be relied upon to provide structural support, insulation, and/or sound barrier. The foam can be a pre-made part or can be made by utilizing a poured-in-place process. The poured-in-place process typically includes a step of pouring or injecting foam into the cavity formed by frames. Undesirable air pockets may be formed during the manufacturing process and can cause doors to be of poor quality or to be rejected. Air pockets are formed when foam is injected into the door, trapping air inside the door.

SUMMARY

The present disclosure includes a door, a vented building component, a kit for making the door, and a method of making the door. More particularly, the present disclosure includes a door having at least one vented stile and an internal foam material. The vented stile advantageously enables the internal foam material to be formed without trapped air bubbles or pockets therein.

In accordance with some embodiments, a door comprises a first skin providing a first outer door surface, a second skin providing a second outer door surface, and two stiles aligned in parallel along a first direction. The two stiles are disposed at least partially between the first skin and the second skin. At least one stile defines a vent therein. The door further comprises a core comprising a foam material disposed between the first skin and the second skin, and a gas permeable membrane disposed on the at least one stile. The gas permeable membrane has a first side facing and covering the vent, and a second side opposite to the first side. The second side contacts the foam material in the core.

The gas permeable membrane is permeable to gas, but not permeable to the precursor of the foam material. In some embodiments, the gas permeable membrane includes a non-woven polymer backing providing gas permeability, and is selectively coated with an adhesive in areas contacting the at least one stile on the first side of the gas permeable membrane.

In some embodiments, the vent is oriented along a longitudinal direction of the at least one stile defining the groove.

In some embodiments, the door further comprises two rails aligned in parallel along a second direction, which is perpendicular to the first direction. At least one of the two rails defines a first through hole along the first direction. The first through hole is connected to the vent.

In some embodiments, the at least one of the two rails defines a second through hole along the first direction. The second through hole is connected to the core. The at least one of the two rails may also define a third through hole. A tube extends from the third through hole into the foam material in the core. Each of the first, second, and third through holes may be filled with the same foam material or a sealant.

Such a door may be a door with an insulation core embedded within a cavity defined by the stiles, the rails, and the skins and extending the whole door. In some embodiments, the door may further comprise a glazing unit having at least glass pane mechanically coupled with the first skin and the second skin.

In accordance with some embodiments, an exemplary door comprises a first skin providing a first outer door surface, a second skin providing a second outer door surface, two stiles disposed at least partially between the first skin and the second skin, and two rails disposed at least partially between the first skin and the second skin. At least one stile defines a vent therein. The door further includes a core comprising a foam material, which is disposed between the first skin and the second skin, and inside a cavity defined by the first skin, the second skin, the two rails, and the two stiles. The door further includes a gas permeable membrane disposed on the at least one stile. The gas permeable membrane has a first side facing and covering the vent, and a second side opposite to the first side and contacting the foam material in the core.

In some embodiments, the two stiles are aligned in parallel along a first direction, and the two rails aligned in parallel along a second direction perpendicular to the first direction.

In some embodiments, at least one of the two rails defines a first through hole and a second through hole along the first direction. The first through hole is connected to the vent. The second through hole connected to the core. The at least one of the two rails may further define a third through hole. A tube extends from the third through hole into the foam material in the core. Each of the first, second, and third through holes is filled with the foam material or a sealant in some embodiments.

In another aspect, a vented building component is provided. The vented building component has a body extending from a first end to a second end and having a first side. The first side defines a vent along at least a length thereof that extends to the first side. The vented building component has a gas permeable membrane affixed to the first side of the body such that the gas permeable membrane covers the vent along the first side of the body. In some embodiments, the vented building component is a vented stile or rail for a door. The gas permeable membrane includes a non-woven polymer backing providing gas permeability. One side of the gas permeable membrane is selectively coated with an adhesive configured to be bonded with the body in area contacting the body.

In another aspect, the present disclosure provides a method for making a door as described above. The method comprises steps, including providing a first skin providing a first outer door surface and a second skin providing a second outer door surface, and providing two stiles and two rails. At least one stile defines a vent therein. Such a method further includes applying a gas permeable membrane onto the at least one stile. The gas permeable membrane has a first side facing and covering the vent, and a second side opposite to the first side. The two stiles, the two rails, and the first and second skins are assembled together. The two stiles are aligned in parallel along a first direction and placed at least partially between the first skin and the second skin. The two rails are aligned in parallel along a second direction.

A foamable material is then injected so as to form a core comprising a foam material between the first skin and the second skin. The second side of the gas permeable membrane contacts the foam material in the core. In some embodiments, the foamable material is injected into a cavity defined by the first skin, the second skin, the two stiles, and the two rails.

In some embodiments, at least one of the two rails defines a first through hole along the first direction, which is connected to the vent and configured to vent air and gas during the injecting step. The at least one of the two rails also defines a second through hole along the first direction, and the foamable material is injected from the second through hole. In some embodiments, the at least one of the two rails defines a third through hole, and a tube extends from the third through hole into a gap between the first skin and the second skin. The third through hole is used to vent air and gas in the middle of the cavity during the injecting step.

In some embodiments, such a method includes sealing remaining holes on the at least one of the two rails with the foamable material or a sealant. The remaining holes may be one of the first, the second, and the third through holes.

The method provided in the present disclosure solves the problems of air bubbles or pockets trapped inside a door. The resulting door has no air bubbles or pockets therein and provides high performance and durability.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like reference numerals denote like features throughout specification and drawings.

DETAILED DESCRIPTION

Figure 1A:
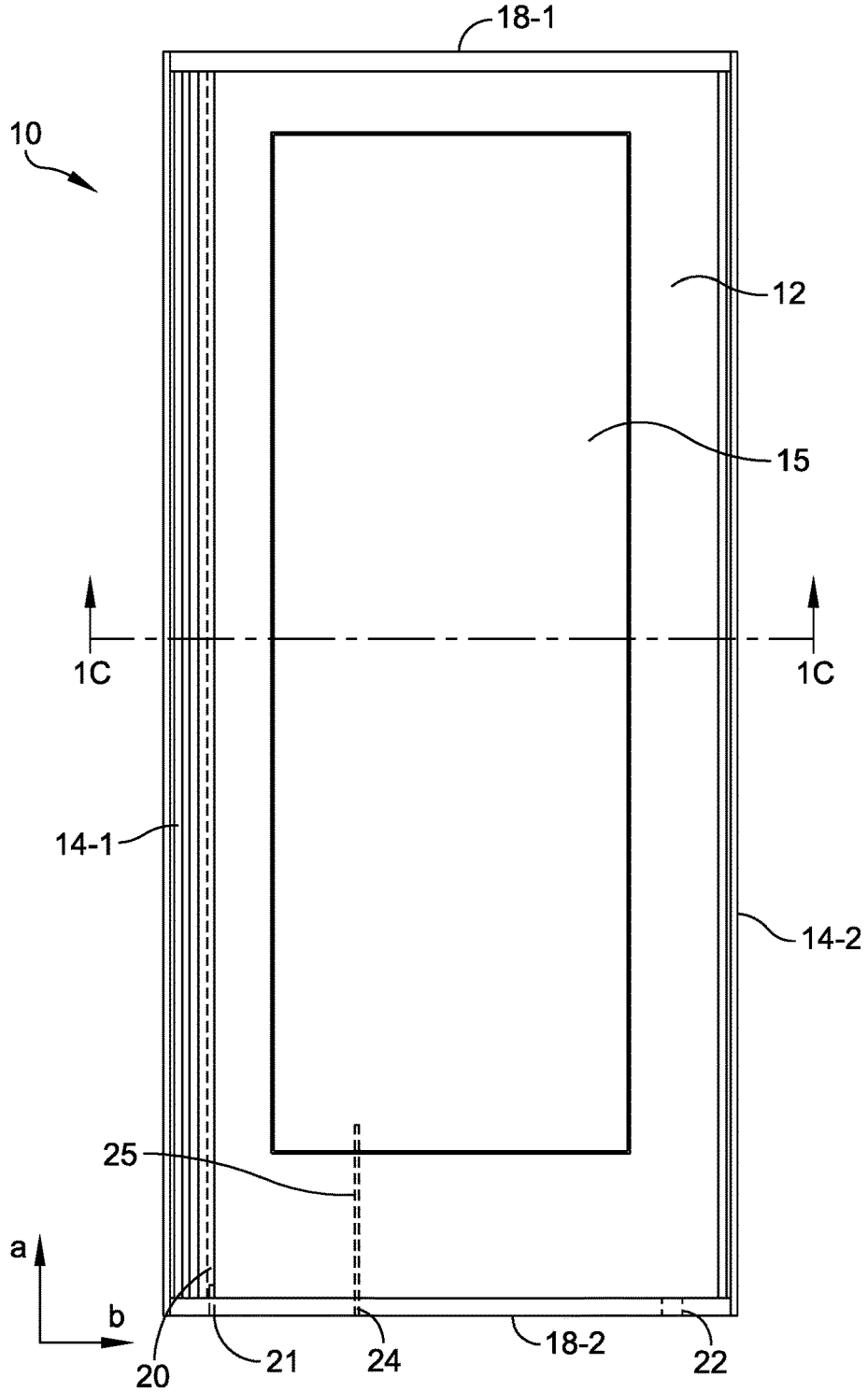
FIG. 1A is a plan view of an exemplary door comprising at least one vented stile in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

For purposes of the description hereinafter, it is to be understood that the embodiments described below may assume alternative variations and embodiments. It is also to be understood that the specific articles, compositions, and/or processes described herein are exemplary and should not be considered as limiting.

In the present disclosure the singular forms "a," "an," and "the" include the plural reference, and reference to a particular numerical value includes at least that particular value, unless the context clearly indicates otherwise. When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive; as another example, the phrase "about 8%" preferably (but not always) refers to a value of 7.2% to 8.8%, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

The present disclosure includes a door, a vented building component, a kit for making the door, and a method of making the door. In accordance with some embodiments, the present disclosure includes a door having at least one vented stile and an internal foam material. The vented stile advantageously enables the internal foam material to be formed without trapped air bubbles or pockets therein during the fabrication process.

Unless expressly indicated otherwise, references to "a vent" made herein are understood to encompass a structure as being formed as a groove, hole, recess, depression, channel, slot, or other suitable structure that permits the flow of air. References to "a gas permeable membrane" made herein are understood to encompass a thin sheet or film having a porous structure so that gas molecules can transport from one side to the other side of the membrane. One example is a tape. The gas permeable membrane is at least partially coated with adhesive on one side for bonding.

Referring to FIGS. 1A-1G and 2A-2B, an exemplary door 10 in accordance with some embodiments comprises skins 12 comprising a first skin 12-1 and a second skin 12-2. The first skin 12-1 provides a first outer door surface 13-1. The second skin 12-2 provides a second outer door surface 13-2. Both skins 12 form the front and back surfaces of the exemplary door 10.

In some embodiments, the skins 12 may comprise a material of a glass fiber reinforced and mineral filled polymer composite, in which the polymer can be any suitable polymer, for example, cured from unsaturated polyester or polybutadiene. The skins 12 can be sheet molded from a sheet molding compound (CMC) in some embodiments.

The exemplary door 10 further comprises at least two stiles 14, at least one core 16, and at least two rails 18. For example, in some embodiments, the stiles 14 include a stile 14-1 and a stile 14-2. The rails 18 includes for a top rail 18-1 and a bottom rail 18-2. The at least one core 16 is disposed between the first skin 12-1 and a second skin 12-2. The at least one core 16 is also disposed between left and right stiles 14-1, 14-2, and between top rail and bottom rails 18-1, 18-2.

The two stiles 14 are aligned in parallel along a first direction, for example, a vertical direction as shown as "a" direction in FIG. 1A. The two stiles 14 are disposed at least partially between the first skin 12-1 and the second skin 12-2. The door 10 further comprises two rails aligned in parallel along a second direction, which is perpendicular to the first direction. For example, the rails 12 are aligned in "b" direction (e.g., horizontally) as shown in FIG. 1A. The core 16 comprising a foam material is disposed between the first skin 12-1 and the second skin 12-2. The two stiles 14 illustrated in FIG. 1A includes a first stile 14-1 referred as a vented strike stile, and a second stile 14-2 referred as a hinge stile in some embodiments.

In some embodiments, the stiles 14 are made of laminated veneer lumber (LVL) or any other suitable material. The rails 18 comprise any suitable materials such as wood, a polymer, or a composite comprising wood and a polymer such as polyvinyl chloride. The rails 18 are made of a wood flour/PVC (polyvinyl chloride) composite in some embodiments.

Each core 16 may be in a shape of a rectangle or square in some embodiments, although the core 16 may have other geometric shapes. The core 16 may comprise a foam material such as polyurethane (PU) in some embodiments. The door 10 may have a rectangular shape.

Figure 1B:
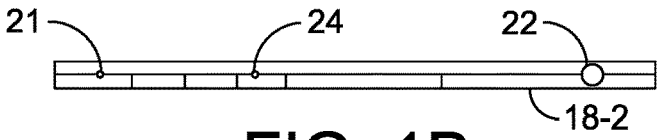
FIG. 1B is a bottom-side plan view of the exemplary door of FIG. 1A.
Figure 1C:
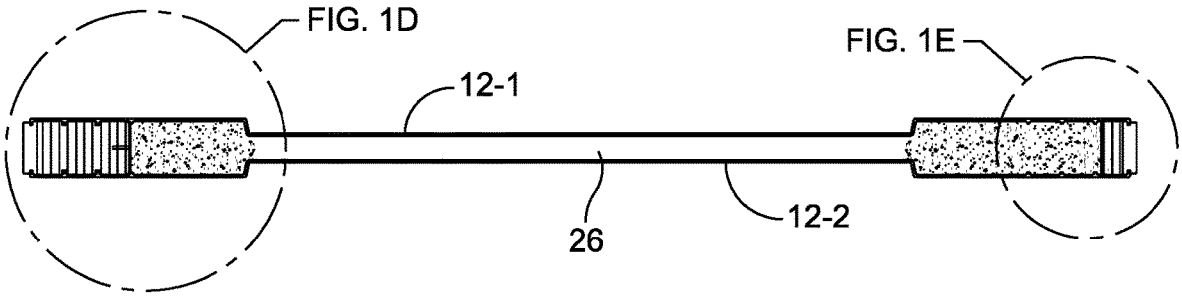
FIG. 1C is a cross-sectional view of one example of a door taken along line 1C-1C in FIG. 1A.

Referring to FIGS. 1A and 1C, in some embodiments, the middle portion 15 of the door 10, which may be a depressed or recessed area, includes the skins 12 and the core 16. The whole cavity 26 between the two skins 12 is also filled with the core 16. The door 10 is a foamed door, for example, an insulation door. In some embodiments, the door 10 may include at least one glazing unit having glass panes (without skins) in the middle portion 15. Such a door is a glazed door.

The at least one core 16, includes one or more pieces of inner cores, which are encased by the skins 12, stiles 14, and rails 18. The at least one core 16 comprises a polyurethane containing composition as described herein.

Figure 1D:
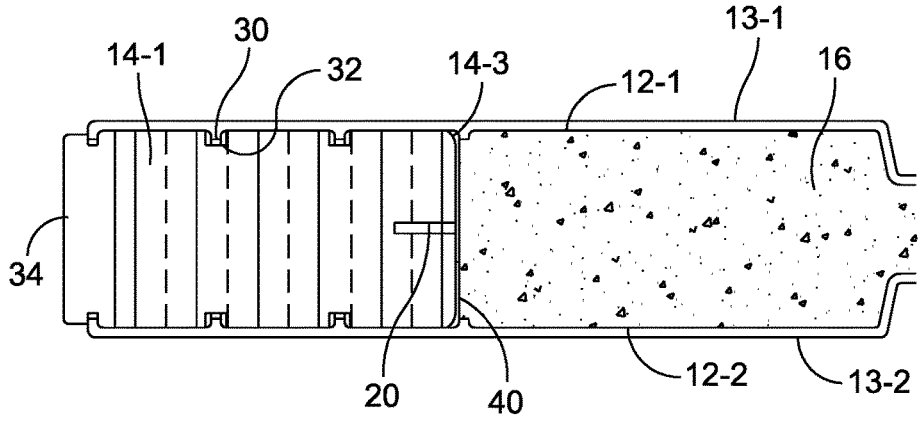
FIGS. 1D-1E are enlarged details of the cross-sectional view in FIG. 1C in accordance with some embodiments.
Figure 2A:
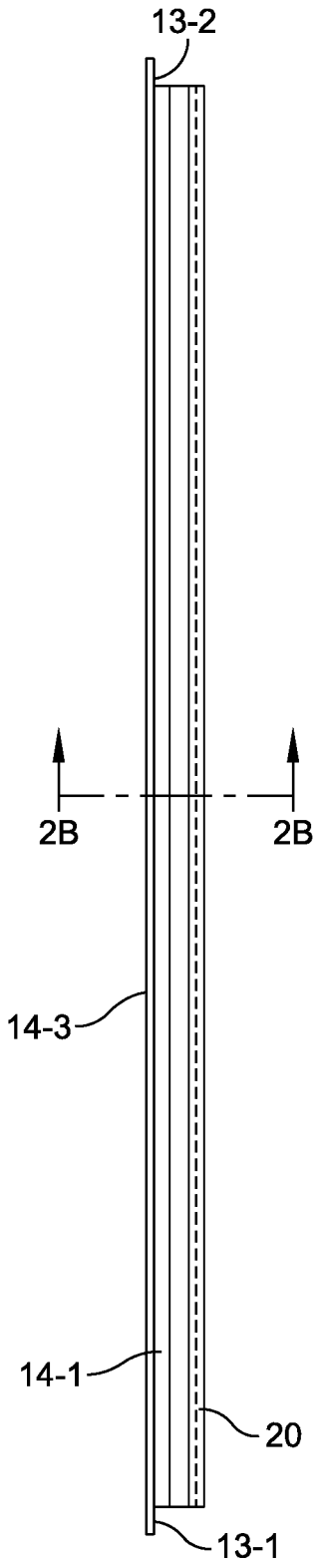
FIG. 2A is a plan view illustrating an exemplary stile comprising a notch therein used in the exemplary door of FIG. 1A in accordance with some embodiments.
Figure 2B:
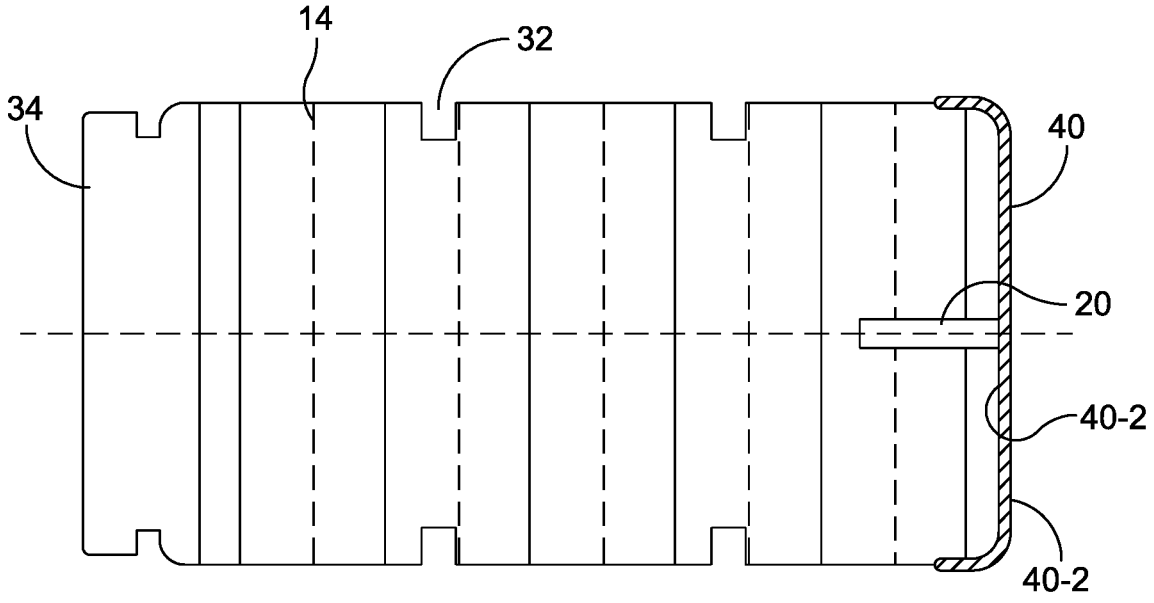
FIG. 2B is a cross-sectional view of the exemplary stile of FIG. 2A taken along line 2B-2B in FIG. 2A.

Referring to FIGS. 1C-1D and 2B, in accordance with some embodiments, at least one stile 14 defines a vent such as a groove 20 therein. Although referred to as a "groove," a person of ordinary skill in the art will understand that the groove may take any number of orientations or configurations. For example, the groove 20 may take the form of a recessed area, channel, or other structural element that may be covered by a gas permeable material to facilitate the egress of air in response to the injection of foam as discussed herein. The groove 20 may be located on a surface 14-3 facing the core 16. The groove 20 may be oriented along a longitudinal direction of the at least one stile 14-1 defining the groove 20. In FIGS. 1C-1D and 2B, only the first stile 14-1 has the groove 20. These drawings are for the purpose of illustration only. In some embodiments, both stiles may have a groove 20. In addition, the stiles 14 and the rails 18 can be used interchangeably. For example, the groove 20 may exist in at least one rail 18.

The groove 20 may have a suitable cross-sectional shape. In FIGS. 1C-1D and 2B, the groove 20 has a rectangular shape in cross section. Examples of other suitable cross-sectional shape include, but are not limited to, a circle, a half-circle, a square, an oval, and an irregular shape.

The exemplary door 10 further comprises a gas permeable membrane 40 disposed on the at least one stile 14-1. As illustrated in FIG. 2B, the gas permeable membrane 40 has a first side 40-1 facing and covering the groove 20, and a second side 40-2 opposite to the first side 40-1. The second side 40-2 contacts the foam material in the core 16. The gas permeable membrane 40 is gas (e.g., air) permeable, but not permeable to the precursor of the foam material, or a glue, which includes oligomers or pre-polymer in a liquid or paste form. In some embodiments, the gas permeable membrane 40 such as a tape includes a non-woven polymer backing providing high gas permeability and meeting the outgassing requirements for foam-in-place insulation processes. The backing is conformable in some embodiments. The gas permeable membrane 40 such as a tape is selectively coated with an adhesive in areas contacting the at least one stile 14-1 on the first side 40-1 of the gas permeable membrane 40. This selective strip coating is configured to provide good gas permeation during the fabrication of the exemplary door 10. Adhesive is strip coated so uncoated areas have higher permeability to help minimize foaming voids. An exemplary tape used is available from 3M Company as 3M™ Venting Tape 3294, which is a pink non-woven, synthetic backing with a strip coated low tack pressure sensitive acrylic adhesive. The tape may have any suitable dimension, for example, 2"×(5 mils). 005". During the manufacturing process, the gas permeable membrane 40 allows air to pass through, but is not permeable for liquid and solid such as the PU foam and the precursors of the PU foam. The air pathway is not coated with adhesive, which is coated for the bonding needed.

Referring to FIGS. 1A-1B, the at least one 18-2 of the two rails 18 defines a first through hole 21 along the first direction. The first through hole 21 is aligned and connected to the groove 20. In some embodiments, the at least one of the two rails 18 defines a second through hole 22 along the first direction. The second through hole 22 is connected to the core 16. The at least one of the two rails 18 may also define a third through hole 24. A tube 25 extends from the third through hole 24 into the foam material in the core 16. Each of the first, second, and third through holes 21, 22, 24 are used during the fabrication, and may be filled with the same foam material or a sealant if needed.

Such a door 10 may be a door with an insulation core 16 embedded within a cavity defined by the stiles 14, the rails 18, and the skins 12 and extending the whole door. In some embodiments, the door may further comprise a glazing unit (not shown) having at least glass pane mechanically coupled with the first skin 12-1 and the second skin 12-2. In some embodiments, the skins 12 may have ribs and flanges, and other fixtures (not shown) for fixing the glazing unit. For example, an exemplary configuration is described in U.S. application Ser. No. 16/104,455, filed on Aug. 17, 2018, which is incorporated by reference herein. As described in U.S. application Ser. No. 16/104,455, each of the first skin and the second skin includes a respective skin body portion providing an outer (e.g., exterior) door surface, and a respective flange portion connected with and extending inwardly from the skin body portion. Each skin body portion has a respective tip. The glazing unit has an edge disposed adjacent to, and between two tips. The end of a first flange portion and the end of a second flange portion have complementary shapes and sizes, and are interconnected to provide an interlocking structure.

Figure 1E:
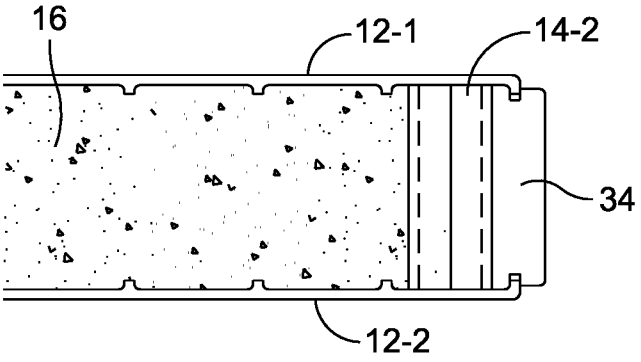

Referring to FIGS. 1D-1E, each of the skins 12-1 and 12-2 may have interior ribs or studs 30 on the interior surfaces protruding into cavities 32 defining by the stiles 14. The stiles 13 may include a stile cap 34, which may be made of a metal or a plastic material. In some embodiments, the stile cap 34 is made of a PVC having wood grain patterns.

Figure 1F:
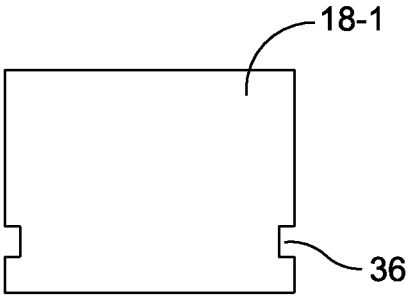
FIGS. 1F and 1G are plan views illustrating two exemplary rails used in the exemplary door of FIG. 1A in accordance with some embodiments.
Figure 1G:
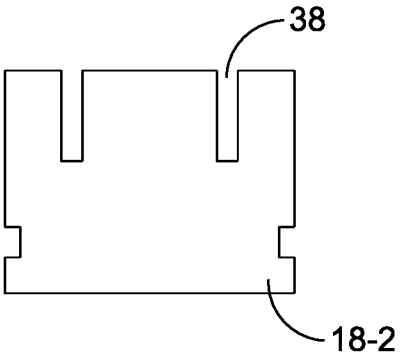

Referring to FIGS. 1F-1G, two exemplary rails 18 including a top rail and a bottom rail, respectively, may include notches 36 and 38 configured to be coupled with the skins 12 and the stiles 14.

Figure 3:
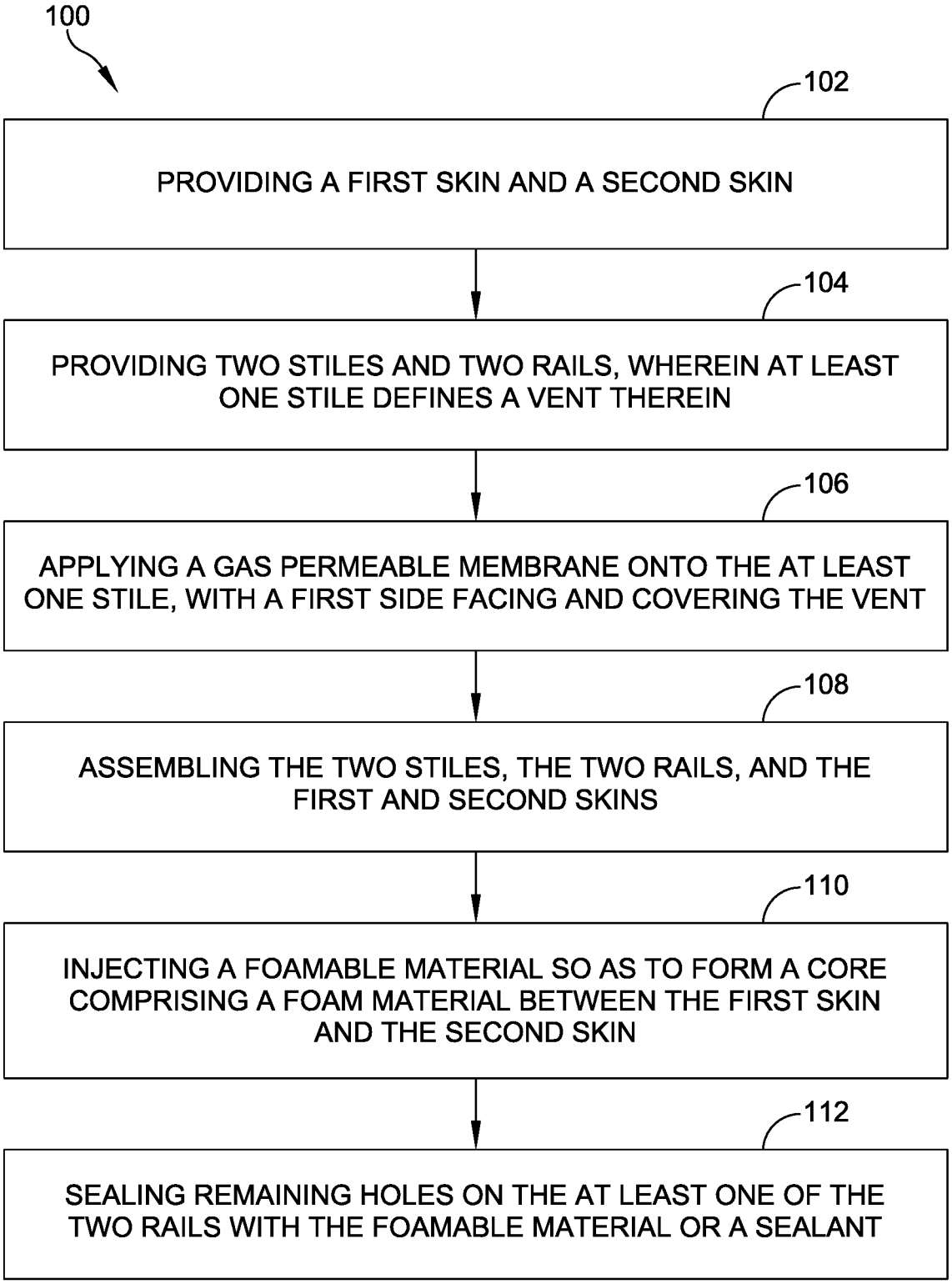
FIG. 3 is a flow chart illustrating an exemplary method of making an exemplary door in accordance with some embodiments.

The present disclosure also provides a method for making a door as described above. Referring to FIG. 3, an exemplary method 100 comprises the following steps:

At step 102, a first skin 12-1 and a second skin 12-2 are provided. The two skins 12 provides a first outer (i.e. exterior) door surface and a second outer door surface, respectively.

Figure 4:
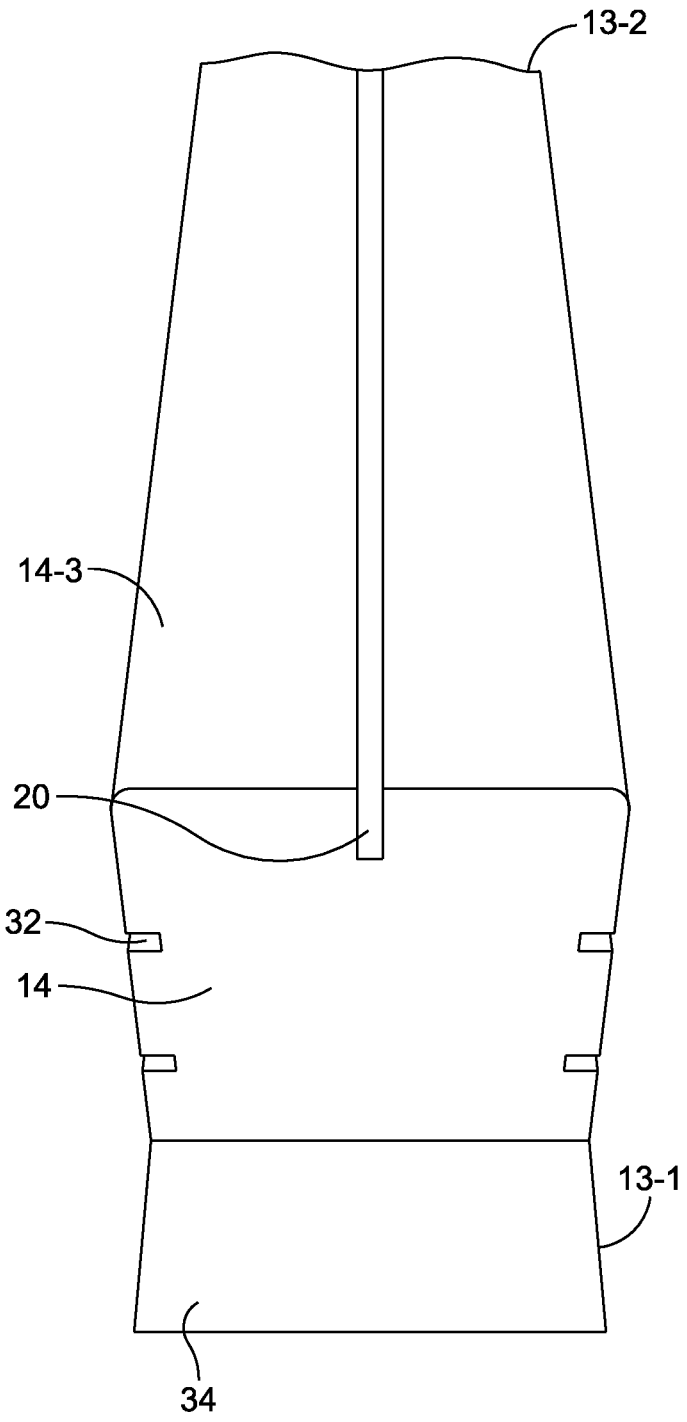
FIG. 4 is a perspective view illustrating an exemplary stile having a slot or groove in accordance with some embodiments.

At step 104, two stiles 14 and two rails 18 are provided. As described, at least one stile 14 defines a groove 20 therein. An exemplary stile 14 is illustrated in FIG. 4.

Figure 5:
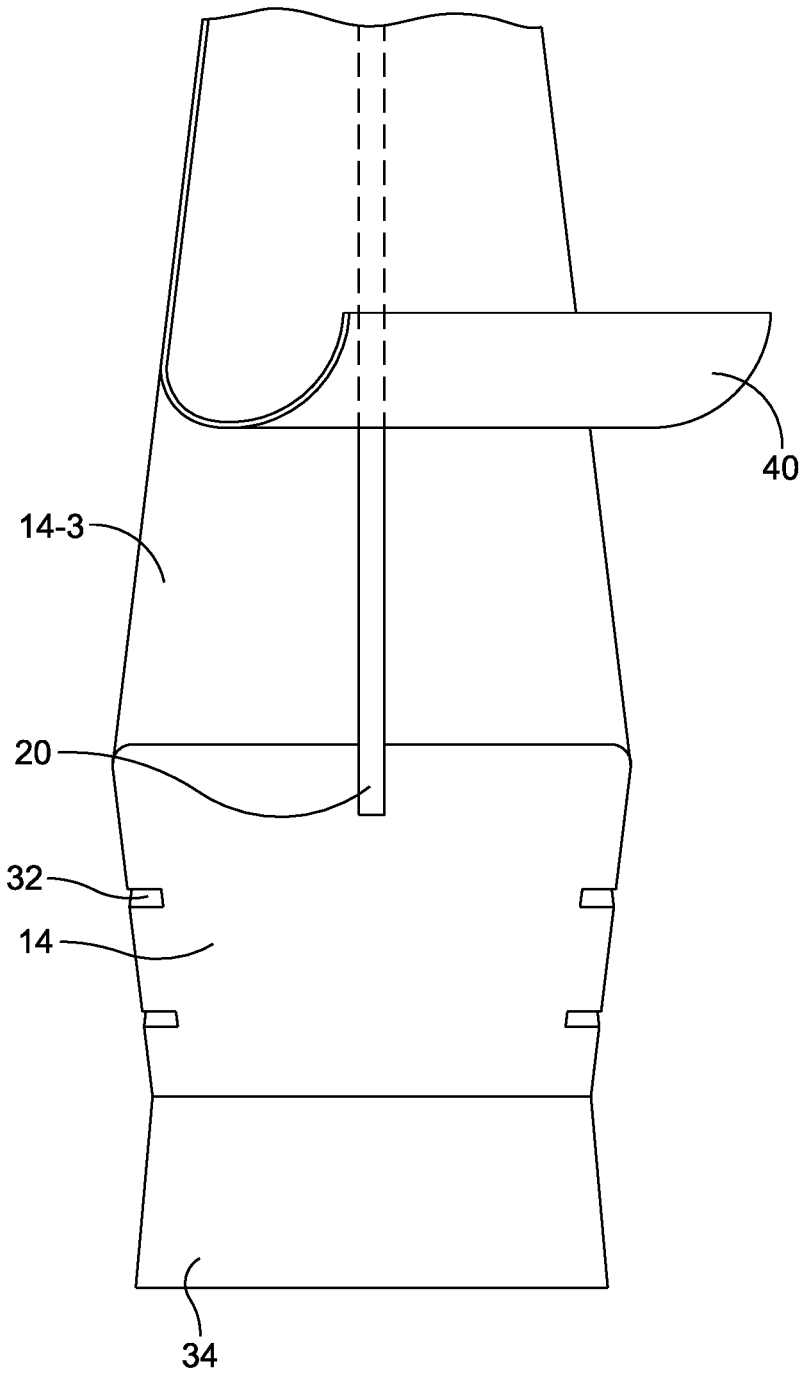
FIG. 5 illustrates the exemplary stile of FIG. 6A, on which a piece of gas permeable membrane is being applied in accordance with some embodiments.
Figure 6:
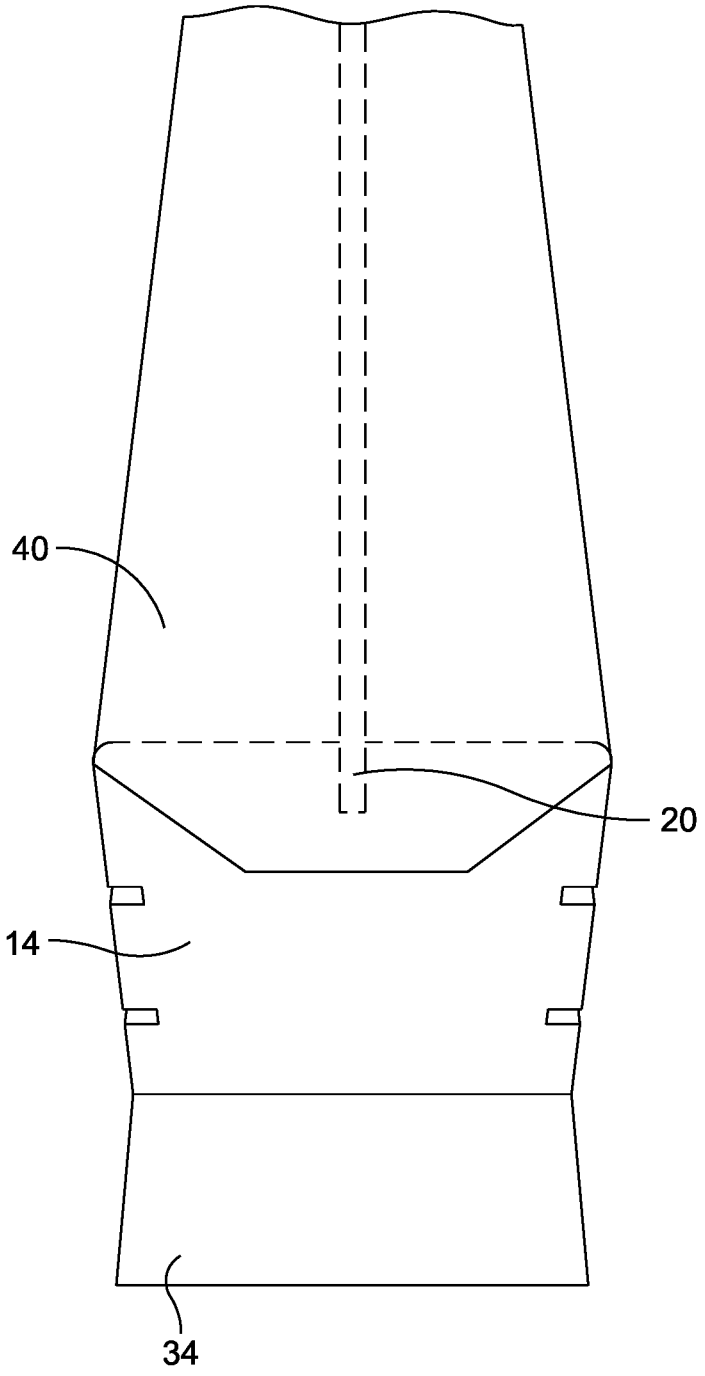
FIG. 6 illustrates the exemplary stile of FIG. 6A with a piece of gas permeable membrane applied thereon and the groove ventable at the end of the stile in accordance with some embodiments.
Figure 7:
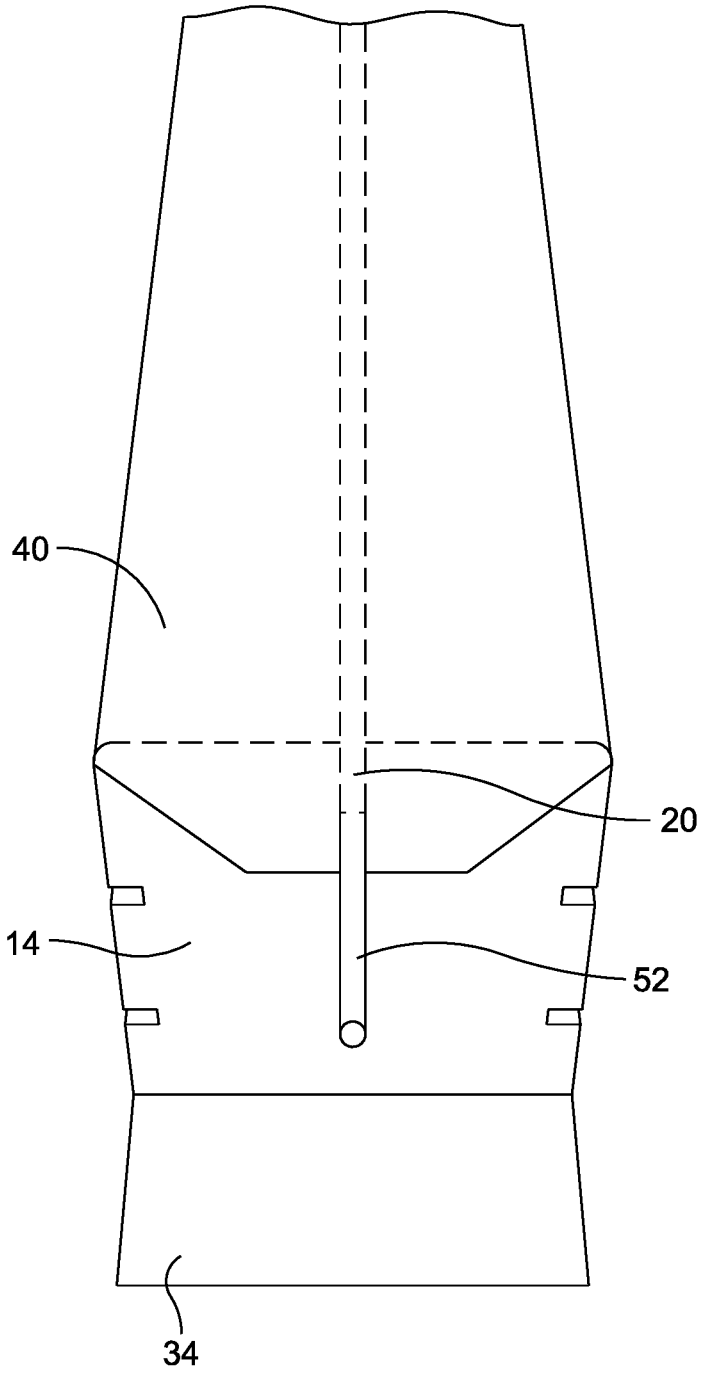
FIG. 7 illustrates the exemplary stile of FIG. 6A with a piece of gas permeable membrane applied thereon and a tube or straw inserted into the groove in accordance with some embodiments.

At step 106 of FIG. 3, referring to FIG. 5, a gas permeable membrane 40 is applied onto the at least one stile 14. The gas permeable membrane 40 is gas permeable, but not permeable to the precursor of a foamable material, which is generally in the form of a liquid. The gas permeable membrane 40 has a first side 40-1 facing and covering the groove 20, and a second side 40-2 opposite to the first side. FIG. 6 illustrates a resulting stile structure after the gas permeable membrane 40 is applied thereon. The gas permeable membrane 40 may have one end folded and bonded onto one end of the stile 14, while the groove 20 is maintained open at the end of the gas permeable membrane 40. As illustrated in FIG. 7, a tubing 52 may be optionally used, is inserted into the groove 20 and extends outside in some embodiments.

At step 108 of FIG. 3, the first and second skins 12, the two stiles 14, the two rails 18, are assembled together to define a cavity 26. The two stiles 14 are aligned in parallel along a first direction and placed at least partially between the first skin 12-1 and the second skin 12-2. The two rails 18 are aligned in parallel along a second direction, which may be normal to the first direction. In some embodiments, the two stiles 14 are aligned in a vertical direction along the vertical edges of the door and at least two rails 18 are aligned in a horizontal direction along the horizontal edges of the door, referring to a resulting door installed for use.

The stiles, the rails, and the skins may be optionally bonded using a glue. Such a glue can be an inorganic glue, a polymer hot melt adhesive (e.g., polyurethane or polyolefin based), or a thermosetting-based polymer adhesive (e.g., epoxy, urethane-based). References to an "inorganic glue" made herein are understood to encompass a chemical agent used for bonding the door core to the stiles and/or rails.

In some embodiments, an inorganic based glue, for example, comprising $Na_2SiO_3$, $MgSiO_3$, and $CaSiO_3$ is used. In some embodiments, polyurethane reactive hot melt adhesive or a polyolefin-based adhesive is used for bonding, for example, a composite cap to the LVL or engineered wood. For example, a polyurethane reactive hot melt adhesive, DURAPRO UH-2125-1, is from IFS Industries, Inc. (Reading, Pa.). DURAPRO UH-2125-1 contains methylene bispenyl isocyanate and other polymer ingredients.

At step 110, a foamable material as the precursor to the foam material is then injected so as to form a core 16 comprising such a foam material between the two skins 12. The second side 40-2 of the gas permeable membrane 40 contacts the foam material in the core 16. In some embodiments, the foamable material is injected into a cavity 26 defined by the two skins 12, the two stiles 14, and the two rails 18. The foamable material may be a curable formulation including precursors of a foam material such as polyurethane (PU) in some embodiments. The air inside is pushed and passes through the gas permeable membrane 40, and is released out from the door assembly through the groove 20 in the at least one stile 14. A mix head might be used and fluidly connected with the second through hole 22. The foam injection at Step 110 may take a period of time in the range of from 3 second to 10 seconds. The mix head is pulled out right after the injection and a plug can be inserted into the second through hole 22 to retain the foamable material with the cavity 26.

As described in FIGS. 1A-1B, in some embodiments, at least one of the two rails 18 defines a first through hole 21 along the first direction. The first through hole 21 is fluidly connected to the groove 20 and configured to vent air and gas during the injecting step. The at least one of the two rails 18 also defines a second through hole 22 along the first direction, and the foamable material is injected from the second through hole 22. In some embodiments, the at least one of the two rails 18 defines a third through hole 24, and a tube 25 such as a plastic tube extends from the third through hole 24 into a gap or the cavity 26 between the first skin 12-1 and the second skin 12-2. The third through hole 24 is used to vent air and gas in the middle of the cavity 26 during the injecting step 110. In some embodiments, a tube such as a plastic tube is optionally inserted into each of the first through hole 21 and the second through hole 22. Each tube may be pulled out, partially cut, or may be partially or fully sealed with the foaming material or an additional sealant.

The at least one stile 14 having a venting groove 20 also comprises a gas permeable membrane 40 applied onto a surface of the stile, i.e., the surface 14-3 of the stile 14 that faces the core. Such a gas permeable membrane 40 is gas permeable, but is not permeable by the foaming material. During the manufacturing process, the gas permeable membrane 40 allows air to pass through, but is not permeable for liquid and solid such as the PU foam and the precursors of the PU foam. So any air or gas generated from the foamable material are vented out through the gas permeable membrane 40 and the groove 20.

At step 112 of FIG. 2, remaining holes on the at least one of the two rails 18 are optionally sealed with the foamable material or a sealant. The sealant may be a polymer formation the same as or different from the foamable material for the core 16. The remaining holes may be one of the first, the second, and the third through holes 21, 22, 24. During the injecting step 110, the foamable material may fill the second and the third holes 22, 24, and the tube 25. In some embodiments, a portion of the groove 20, the end of the groove 20, or the whole groove 20 may be optionally sealed with a sealant. In some embodiments, the groove 20 or the end of groove 20 is sealed with a sealant.

In some embodiments, a rail 18 such as the bottom rail defines a hole 24, and a tube 25, such as plastic tube, is inserted into the hole 24 to the space between the two skins for injecting the foaming material into the space to form the core 16. The tube 25, or the tubing 52 to the groove may be pulled out of the hole 24 or groove 20, or may be cut off such that a portion remains within the rail 18 and/or the core 16. The hole or remainder of the tube may then be sealed with the foaming material or an additional sealant. In some embodiments, the tube 25 and the tubing 52 are made of an optically clear plastic material.

Figure 8:
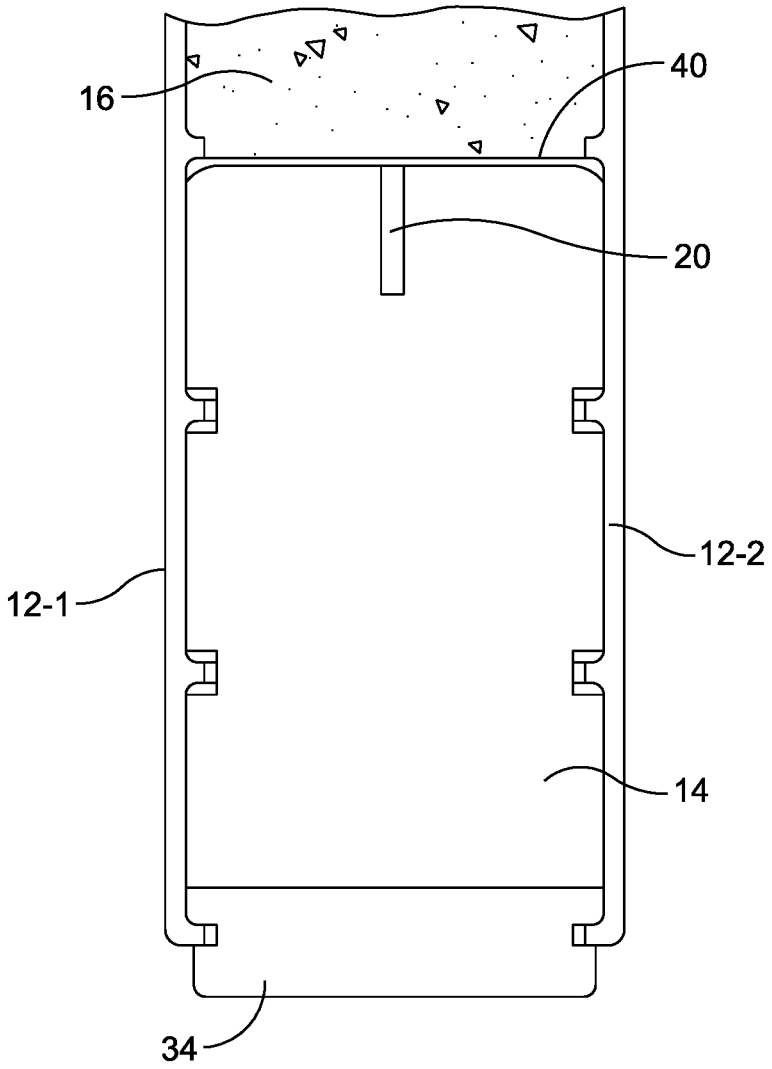
FIG. 8 is a cross-sectional view illustrating a portion of an exemplary foamed door having a vented stile and a gas permeable membrane, but not permeable to a foam material during the fabrication process, in accordance with some embodiments.

Referring to FIG. 8, a portion of a resulting exemplary door 10 is illustrated. Such a door 10 has a vented stile 14 and a gas permeable membrane 40 being gas permeable, but not permeable to a foam material during the fabrication process, in accordance with some embodiments. The resulting structure is the same as that described above, for example, in FIG. 1D.

Figure 9A:
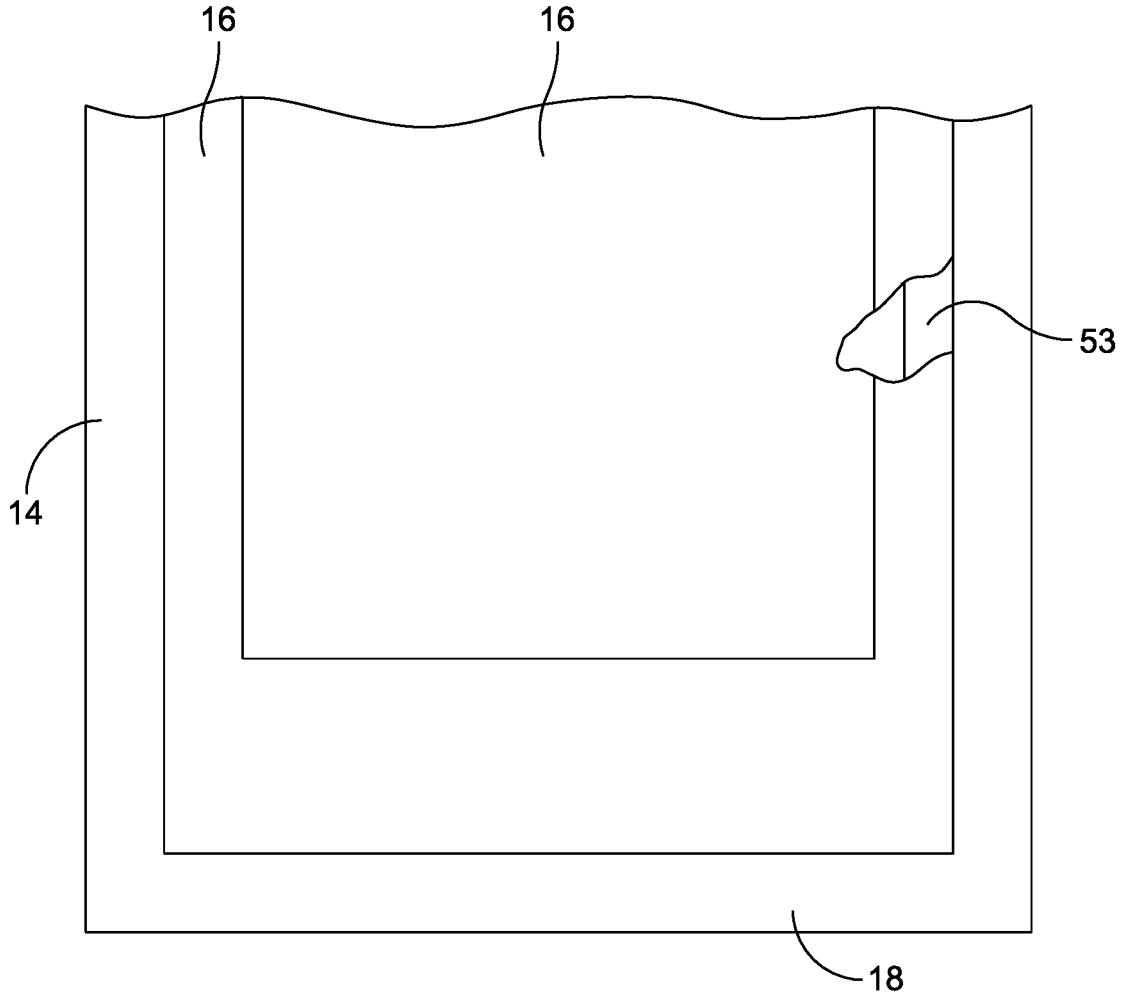
FIG. 9A illustrates a comparative door example without a ventable stile in some embodiments showing air pockets after cut open.
Figure 9B:
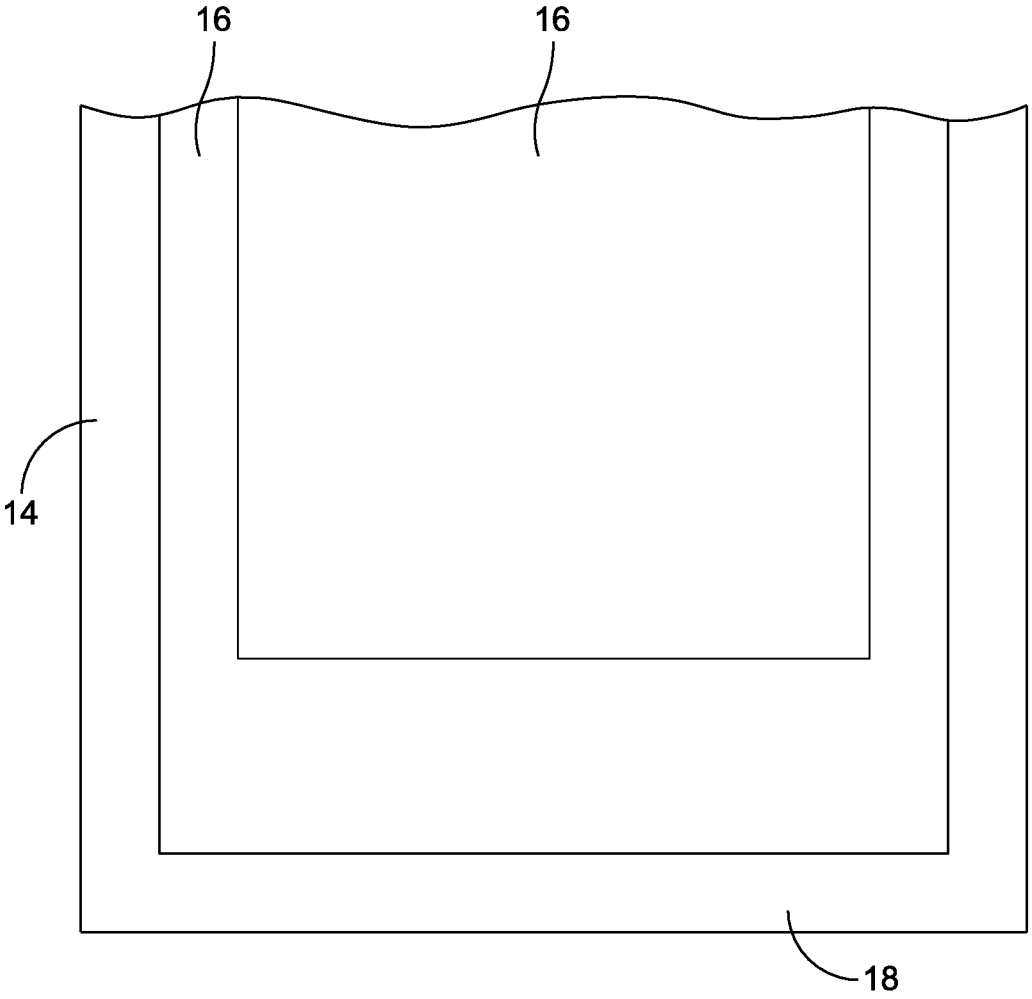
FIG. 9B illustrates an exemplary door with a vented stile in accordance with some embodiments, showing no air pocket after cut open.

FIG. 9A illustrates a comparative door example without a ventable stile and a gas permeable membrane in some embodiments. Such a comparative door includes air pockets after cut open. FIG. 9B illustrates an exemplary door with a vented stile in accordance with some embodiments, showing no air pocket after cut open. FIGS. 9A-9B were made based on photos taken from the samples made. FIGS. 9A-9B illustrate a foamed door having a core 16 disposed inside the whole cavity 26 between the two skins 12, including the middle depressed portion 15. The method and the related structure provided in the present disclosure solve the problems of air bubble trapped inside a door. The resulting door as described has no air bubbles therein and provides high performance and durability.

The present disclosure also includes a vented building component. One example is the vented stile 14-1 as described. The vented stile 14-1 is described for the purpose of illustration only. Referring to FIGS. 2A-2B, and 4-7, the vented building component 14-1 has a body extending from a first end 13-1 to a second end 13-2 and having a first side 14-3. The first side 14-3 defines a vent 20 along at least a length thereof that extends to the first side 14-3. The vented building component 14-1 has a gas permeable membrane 40 as described affixed to the first side 14-3 of the body such that the gas permeable membrane 40 covers the vent 20 along the first side of the body. In addition to a stile, the vented building component 14-1 can also be a vented rail for a door. As described, in some embodiments, the gas permeable membrane 40 includes a non-woven polymer backing providing gas permeability. One side of the gas permeable membrane 40 is selectively coated with an adhesive configured to be bonded with the body in area contacting the body.

The present disclosure also provides a kit or a product comprising the components described herein, and a resulting door assembly. In some embodiments, the kit or the door assembly comprises at least two skins 12 (outer skins), at least two stiles 14, at least one core 16 (inner core) or a foaming material for the core 16, at least two rails 18, and the gas permeable membrane 40. The skins 12 are fiberglass door skins, and the at least one core 16 may comprise polyurethane foam in some embodiments. The rails 18 comprise a wood flour/polyvinyl chloride composite material. The stiles 14 comprise polyvinyl chloride exterior cap 34 bonded to a laminated veneer or engineered structural lumber. The skins 12 comprise a match-molded high-compression unsaturated polyester and or poly-butadiene, glass-fiber-reinforced, mineral-filled composite material. At least one stile 14 has a venting groove as described. At least one rail may have the through holes as described. The holes can be also on the top rail or on another stile.

Although the subject matter has been described in terms of exemplary embodiments, it is not limited thereto. Rather, the appended claims should be construed broadly, to include other variants and embodiments, which may be made by those skilled in the art.

What is claimed is:

1. A door comprising:

a first skin providing a first outer door surface;

a second skin providing a second outer door surface;

two stiles aligned along a first direction and disposed at least partially between the first skin and the second skin, wherein at least one stile of the two stiles defines a groove therein;

two rails aligned along a second direction, the second direction is different from the first direction;

a gas permeable membrane disposed on the at least one stile of the two stiles such that at least a portion of the gas permeable membrane covers a part of the groove; and a core comprising a foam material disposed between the first skin and the second skin, wherein the gas permeable membrane is disposed between and separates the core and the groove, wherein the gas permeable membrane has a porous structure and is impermeable to liquids, and wherein at least one of the two rails defines at least one through hole connected to the groove along the first direction.

2. The door of claim 1, wherein the first skin and the second skin comprises a polymer composite.

3. The door of claim 2, wherein the polymer composite is a glass fiber reinforced or mineral filled polymer composite.

4. The door of claim 1, wherein the groove is along a longitudinal direction of the at least one stile defining the groove.

5. The door of claim 1, wherein the two stiles are aligned in parallel, the two rails are aligned in parallel, and the second direction is perpendicular to the first direction.

6. The door of claim 1, wherein the at least one through holes is filled with the foam material or a sealant.

7. The door of claim 1, wherein the gas permeable membrane includes a non-woven polymer backing providing gas permeability, and is selectively coated with an adhesive in areas contacting the at least one stile on a first side of the gas permeable membrane.

8. The door of claim 1, further comprising a glazing unit having at least glass pane mechanically coupled with the first skin and the second skin.

9. A method for making a door, comprising steps of:

providing a first skin providing a first outer door surface and a second skin providing a second outer door surface;

providing two stiles and two rails, wherein at least one stile of the two stiles defines a groove therein;

applying a gas permeable membrane onto the at least one stile of the two stiles such that at least a portion of the gas permeable membrane covers a part of the groove;

assembling the two stiles, the two rails, and the first and second skins; and injecting a foamable material so as to form a core comprising a foam material between the first skin and the second skin, wherein the gas permeable membrane is disposed between and separates the core and the groove, wherein the gas permeable membrane has a porous structure and is impermeable to liquids, and wherein at least one of the two rails defines at least one through hole connected to the groove along the first direction.

10. The method of claim 9, wherein the first skin and the second skin comprises a polymer composite.

11. The method of claim 9, wherein the foamable material is injected into a cavity defined by the first skin, the second skin, the two stiles, and the two rails.

12. The method of claim 9, wherein the at least one through hole is connected to the groove and configured to vent air and gas during the injecting step.

13. The method of claim 9, further comprising sealing remaining holes on the at least one of the two rails with the foamable material or a sealant.

14. The method of claim 13, wherein the at least one through holes is filled with the foam material or a sealant.

15. The method of claim 9, further comprising mechanically coupling a glazing unit having at least glass pane with the first skin and the second skin.

16. A kit for a door, comprising:

a first skin configured to provide a first outer door surface;

a second skin configured to provide a second outer door surface;

two stiles configured to be aligned along a first direction and disposed at least partially between the first skin and the second skin, wherein at least one stile of the two stiles defines a groove therein;

two rails configured to be aligned along a second direction, the second direction is different from the first direction; and a gas permeable membrane disposed on the at least one stile such that at least a portion of the gas permeable membrane covers a part of the groove, wherein the gas permeable membrane is configured to be disposed between and separate the groove and a core comprising a foam material configured to be disposed between the first skin and the second skin, wherein the gas permeable membrane has a porous structure and is impermeable to liquids, and wherein at least one of the two rails defines at least one through hole configured to be connected to the groove along the first direction.

17. The kit of claim 16, wherein the first skin and the second skin comprises a polymer composite.

18. The kit of claim 16, wherein the gas permeable membrane includes a non-woven polymer backing providing gas permeability.

19. The kit of claim 18, wherein one side of the gas permeable membrane is selectively coated with an adhesive configured to be bonded with the at least one stile defining the groove therein.

20. The kit of claim 16, further comprising a glazing unit having at least glass pane configured to be mechanically coupled with the first skin and the second skin.

* * * * *